US006472984B1

(12) United States Patent
Risi

(10) Patent No.: US 6,472,984 B1
(45) Date of Patent: Oct. 29, 2002

(54) SECURITY ENTRANCE SYSTEM

(75) Inventor: Alan J. Risi, Beechhurst, NY (US)

(73) Assignee: Georal International Ltd., Whitestone, NY (US)

( * ) Notice: Subject to any disclaimer, the term of this patent is extended or adjusted under 35 U.S.C. 154(b) by 0 days.

(21) Appl. No.: 09/772,490

(22) Filed: Jan. 30, 2001

Related U.S. Application Data

(63) Continuation of application No. PCT/US99/03218, filed on Feb. 12, 1999.

(60) Provisional application No. 60/104,874, filed on Oct. 20, 1998.

(51) Int. Cl.[7] ..... G08B 21/00

(52) U.S. Cl. ..... 340/540; 340/541; 340/545.2; 340/606; 49/31; 49/68; 109/68; 109/71

(58) Field of Search ..... 340/540, 541, 340/545.1, 545.2, 545.9, 506, 666; 49/31, 68; 109/3, 6, 13, 21, 64, 68, 71

(56) References Cited

U.S. PATENT DOCUMENTS

| | | | | |
|---|---|---|---|---|
| 4,060,039 A | | 11/1977 | Lagarrigue | 109/3 |
| 4,461,221 A | | 7/1984 | Schandle et al. | 109/6 |
| 4,656,954 A | | 4/1987 | Tonali | 109/6 |
| 4,796,542 A | | 1/1989 | Lee | 109/8 |
| 5,542,211 A | | 8/1996 | Colombo | 49/42 |
| 5,552,766 A | | 9/1996 | Lee et al. | 340/541 |
| 5,600,303 A | * | 2/1997 | Husseiny et al. | 340/568.2 |
| 5,692,446 A | | 12/1997 | Becker et al. | 109/3 |
| 5,694,867 A | | 12/1997 | Diaz-Lopez | 109/6 |
| 5,841,346 A | * | 11/1998 | Park | 340/540 |
| 5,992,094 A | * | 11/1999 | Diaz | 49/31 |
| 6,057,761 A | * | 5/2000 | Yukl | 340/568.1 |
| 6,076,303 A | * | 6/2000 | Orsini | 49/68 |
| 6,218,943 B1 | * | 4/2001 | Ellenbogen | 340/572.4 |
| 6,298,603 B1 | * | 10/2001 | Diaz | 49/68 |
| 6,342,696 B1 | * | 1/2002 | Chadwick | 250/225 |
| 6,375,697 B2 | * | 4/2002 | Davies | 55/340 |

* cited by examiner

*Primary Examiner*—Daniel J. Wu
*Assistant Examiner*—Toan Pham
(74) *Attorney, Agent, or Firm*—Lerner, David, Littenberg, Krumholz & Mentlik, LLP

(57) ABSTRACT

A security entrance system for controlling access from an infeed area (98) to a protected area (100) has a structure (24) defining a chamber disposed between the infeed area and the protected area, with first doors (38) at the infeed end of the chamber and second doors (46) at the protected area end of the chamber. A person entering the protected area must pass through a contraband detector such as a metal detector (90, 92) and enter the chamber. If no alarm was provided by the detector, the doors allow exit from the chamber into the protected area. If an alarm was provided by the metal detector, the doors only allow the person to pass back from the chamber into the infeed area and away from the protected area. The chamber is weighed or otherwise examined after at least some cycles of operation to assure that no contraband was concealed within the chamber.

15 Claims, 5 Drawing Sheets

SECURITY ENTRANCE SYSTEM

CROSS-REFERENCE TO RELATED APPLICATIONS

The present application is a continuation of PCT International Application PCT/US99/03218, filed Feb. 12, 1999, which International Application was published by the International Bureau in English on Apr. 27, 2000, and the disclosure of which is inorporated by reference herein. The present application claims benefit of United State Provisional patent application Ser. No. 60/104,874, filed Oct. 20, 1998, the disclosure of which is incorporated by reference herein.

BACKGROUND OF THE INVENTION

The present invention relates to the field of security entrance systems and more particularly relates to a security entrance system for restricting access from one area to another area.

Many security systems depend on perimeter protection against contraband. For example, in a typical airport security system, devices such as electromagnetic metal detectors are used to prevent smuggling of weapons from an unprotected area, also referred to as the "infeed" area" into the protected area of the airport terminal. Metal detectors and other devices adapted to detect weapons can be deployed in a similar manner to protect other protected areas as, for example, military installations, utility control centers, police stations and other installations susceptible to terrorism. A similar perimeter protection approach can be applied using devices to detect other types of contraband. For example, drug detection devices rather than metal detectors can be applied at customs entry ports. In this instance, the infeed area may constitute the region accessible to incoming travelers prior to customs inspection, whereas the protected area may constitute the free or unrestricted, post-customs region.

Protection using only a detection device such as a metal detector requires constant monitoring of the boundary between the infeed area and the protected area. If the monitoring personnel relax their vigilance even a moment, a smuggler can enter or pass contraband through the opening protected by the detector. For this reason, automatic doors can be used in combination with contraband detectors such as metal detectors. For example, a metal detector may be connected to an automatic door at the entry to the protected area, so that the metal detector detects any metal carried by the person before the person reaches the door and opens the door only if no metal is detected. If the metal detector has detected metal, the door does not open and the person must pass back into the in-feed area through the metal detector. Such a system can be defeated by a smuggler who simply leaves contraband such as a gun behind at the door, just past the metal detector, in a region which is not examined by the metal detector system. The smuggler steps back out of the system through the metal detector. He then surrenders some innocent metal object such as keys to the security officers monitoring the system to provide an innocent explanation for the initial metal detection and re-enters the protected area through the metal detector, which does not detect any metal. As the door opens, the smuggler retrieves the contraband and enters the protected area.

Some security systems restrict access to a protected area to a designated set of individuals. For example, an entrance to an industrial plant may be provided with doors which require a physical token such as a unique pass card or entry of a unique code to open the door. Other systems use biometric measurements such as hand measurements, pupillary pattern recognition or other biometric parameters to identify a particular authorized user. For example, an employee may insert his or her hand into the machine and physical measurements of the hand may be checked against a database of hand measurements for authorized users. Such arrangements may be combined with a contraband detection system as discussed above. To obtain entry, the employee presents his or her pass card, enters his or her code or provides a biometric measurement. If the system recognizes the pass card, code or biometric measurement, it allows the employee to open the door and also records the identity of the employee and the time of entry. Such systems theoretically can exclude unauthorized persons and can also keep track of the entries and exits of authorized persons. However, these systems can be defeated if more than one person enters the protected area when the door is open. For example, if a first authorized person enters the proper code, the door will operate in response to the code. Two or more people may enter the protected area when the door operates. If an authorized person is careless, or if an authorized person is acting under duress, he or she may let an unauthorized person enter the protected area.

Accordingly, despite all of the effort which has been devoted to contraband detection and security entrance systems in the art heretofore, there are still considerable needs for improvement in security systems and methods.

SUMMARY OF THE INVENTION

The present invention addresses these needs.

One aspect of the present invention provides a security entrance system for restricting access from an infeed area to a protected area. A security system in accordance with this aspect of the invention desirably includes a structure defining an enclosed chamber with a first opening connecting the interior of the chamber with the infeed area and a second opening connecting the interior of the chamber with the protected area. The structure defining the chamber includes one or more first doors movable between a closed position in which the first doors block the first opening and an open position in which the first doors do not block such opening. The structure defining the chamber also includes one or more second doors movable between a closed position in which the second doors block the second opening and an open position in which the second doors do not block the second opening. This system desirably further includes a detector arranged to detect contraband entering the chamber through the first opening as, for example, a electromagnetic or other known metal detector for detecting weapons, a chemical detector such as an ion scan system or other chemically sensitive system for detecting chemical contraband such as drugs or explosives.

The system further includes a chamber monitoring system which is connected to the structure. The chamber monitoring system is arranged to detect at least one characteristic of the structure defining the chamber. Preferably, the chamber monitoring system is arranged to detect the weight of the structure. The entrance system according to this aspect of the invention desirably also includes a controller connected to the doors, the detection system and the chamber monitoring system.

The controller desirably is arranged to operate cyclically. In one normal operating mode, each cycle of the controller includes an entry phase in which the first door is open to allow a person entry to the chamber, and the detection system is actuated to monitor the entrance to the chamber for contraband. In a further phase of the cycle, the first door or doors are closed and the second door or doors are allowed to open only if no contraband was detected in the entry phase and only while the first door is closed. Thus, the system will not allow a person into the protected area through the second opening unless the first door is closed and no contraband was detected. If no contraband was detected, the cycle ends when the person passes through the second opening, whereupon the second door or doors close. If contraband was detected, the first door or doors are reopened and the cycle ends when the person passes back out of the chamber through the first opening.

At the end of each cycle, or at least at the end of each cycle in which contraband passing into the chamber was detected by the metal detector or other contraband detector, the controller checks the structure characteristic such as the weight of the structure and chamber when no person is present in the chamber. The controller is arranged to inhibit operation of at least one of the doors during the next cycle if the characteristic of the structure determined by the monitoring system differs from a normal value of such characteristic. For example, if the weight of the chamber-defining structure with no person in the chamber is heavier than its normal empty weight, after the end of a cycle in which the metal detector issued an alarm, the controller may inhibit opening of the first door or the second door. Stated another way, after contraband has been detected in the chamber when a person leaves, the system shuts down and blocks access to the protected area until the condition is cleared manually by security personnel.

Thus, the system will inhibit passage of a person through the system into the protected area if an object is left in the chamber by a preceding person. Likewise, if a smuggler leaves a gun or other contraband within the chamber and steps back out of the chamber, the monitoring system will prevent the smuggler from entering the protected area by re-entering the chamber. The security personnel monitoring the system can reset the system to resume normal operation after inspecting the chamber.

Desirably, the structure is arranged to enclose the interior of the chamber so that a person who is disposed within the chamber with both doors closed cannot reach any part of the system which is not a part of the structure monitored by the chamber monitoring system. Stated another way, the system is arranged so that when the doors are closed, every surface which the person inside the chamber can touch is part of the structure which is weighed or otherwise measured by the monitoring system. Therefore, it is impossible for a person to conceal contraband within the chamber.

However, after a cycle has started, the controller is arranged to permit open the first door if opening of the second door is inhibited. Therefore, if a person is denied access to the protected area by inhibition of the second door opening, as if contraband is detected, the person can pass back into the infeed area from the chamber through the first opening. The person will not be trapped within the chamber. Typically, the security entrance system is arranged to emit an alarm signal if contraband is detected or if the chamber monitoring system detects a change in the characteristics of the chamber as, for example, a change in the weight of the chamber. Typically, the chamber monitoring system includes a base and one or more force transducers connected between the chamber and the base for providing signals related to the weight of the chamber, doors and associated structures. The system optionally may include an activation system for testing a person seeking entry and providing an authorization signal to the controller if such test is passed, thereby establishing that the person is an authorized user. The controller can be arranged to inhibit operation of at least one of the doors if no authorization signal is received from the activation system. For example, the activation system may include a keypad for manual entry of codes and a code comparator for comparing the entered codes to valid codes; a token detector for detecting a badge or other token issued to authorized users; or biometric measurement devices for measuring a biometric characteristic of a person seeking entry.

The same weighing system used to weigh the structure defining the chamber-defining structure when no person is present may also be used to weigh the structure during a cycle while a person is present in the chamber. The controller may be arranged to inhibit operation of the second door unless the detected weight is within preset parameters. For example, the system may be arranged to inhibit operation of the second door if the total weight of the chamber and associated structures with a person in the chamber is above a predetermined maximum threshold, thus indicating that two or more persons are present in the chamber. A fixed maximum threshold may be applied for all authorized users as, for example, about 100 kg over the normal, empty weight of the chamber and associated structures. This provides protection against entry of an unauthorized person along with an authorized person.

Alternatively or additionally, the system may be arranged to inhibit operation of the second door if the weight of the chamber and structures is below a preset person-present threshold as, for example, 6 ounces to 10 Kg above the empty weight of the structure, indicating that no one is present in the chamber.

Where the activation system detects the identity of the user as, for example, by entry of individualized user codes or the use of individualized tokens or biometrics, the system may be arranged to allow opening of the second door only if the total weight of the system is within a relatively narrow range of weights corresponding to the weight with the particular identified individual plus the normal empty weight of the chamber. Weighing systems of this nature assure that the second door will not be opened if the authorized user is accompanied by another person or if a different person has somehow obtained the authorized user's code or token.

The foregoing embodiments of the system provide significant safeguards against entry of unauthorized persons along with authorized persons. Moreover, the weight threshold testing features can be provided using the same weighing system which is used to weigh the chamber and structures while no person is present. Stated another way, the additional security afforded by weight checking while a person is present, and the additional security provided by weighing the empty chamber and associated structures can be accomplished using the same structural elements.

Still further aspects of the present invention provide methods of restricting access to a protected area. Methods according to this aspect of the invention desirably include the steps of providing a chamber having one or more first doors and one or more second doors, opening the first doors to allow a person entry into the chamber from a infeed area and sensing for contraband as the person enters the chamber. Methods according to this aspect of the invention further include the step of closing the first door and opening the second door if no contraband was sensed as the person entered the chamber so as to allow the person in the chamber access to the protected area. The method includes the step of maintaining the second door closed if contraband was sensed. Most preferably, the method according to this aspect of the invention includes the additional step of detecting the presence of objects remaining in the chamber after a person has vacated the chamber, and inhibiting further opening of at least one of the doors if an object is detected in the chamber. As discussed above with reference to the apparatus, methods according to this aspect of the invention can use a weighing system or other system for measuring the weight or other physical characteristics defining the chamber. Also as discussed above with reference to the apparatus, the methods desirably include weighing the chamber while a person is present therein and comparing the detected weight to a threshold or range. Such threshold or range which may be a generic for all persons or may be a specific threshold or range for a specific authorized user of the system.

These and other objects, features and advantages of the present invention will be more readily apparent from the detailed descriptions set forth below, taken in conjunction with the accompanying drawings.

DETAILED DESCRIPTION OF THE PREFERRED EMBODIMENTS

Figure 2:
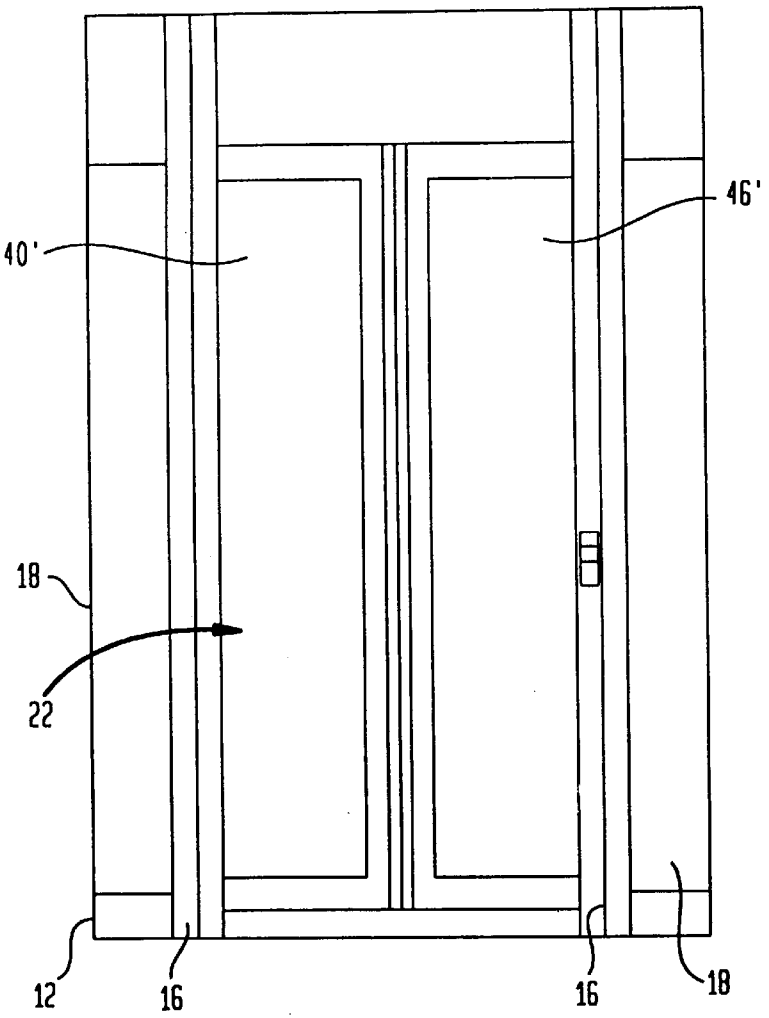
FIG. 2 is a diagrammatic front elevational view of the system shown in FIG. 1.

A security system in accordance with one embodiment of the invention includes an external housing 10 having a bottom portion 12, top portion 14 and four pillars 16 extending between the top and bottom portions and forming side walls of the outer frame. There is a first portal 20 at a first or infeed end of the frame, between pillars 16*a* and 16*b* (FIG. 5) and a second portal 22 at the second or protected-area end of the frame. Side walls 18 extend between the pillars but do not block the portals. The side walls of the external structure desirably are formed from a transparent but strong material such as a bullet resistant glass.

The system further includes an internal structure 24 having a floor element 26, a ceiling element 28 and a set of vertical frame members 30 extending between the floor and ceiling elements. A pair of inner side walls 32 formed from a transparent material such as glass or transparent polymer are mounted to the vertical frame elements 30 and extended between the floor element 26 and ceiling element 28. The internal structure defines a first opening 34 at the infeed end and a second opening 36 at the outfeed or protected area end.

Figure 3:
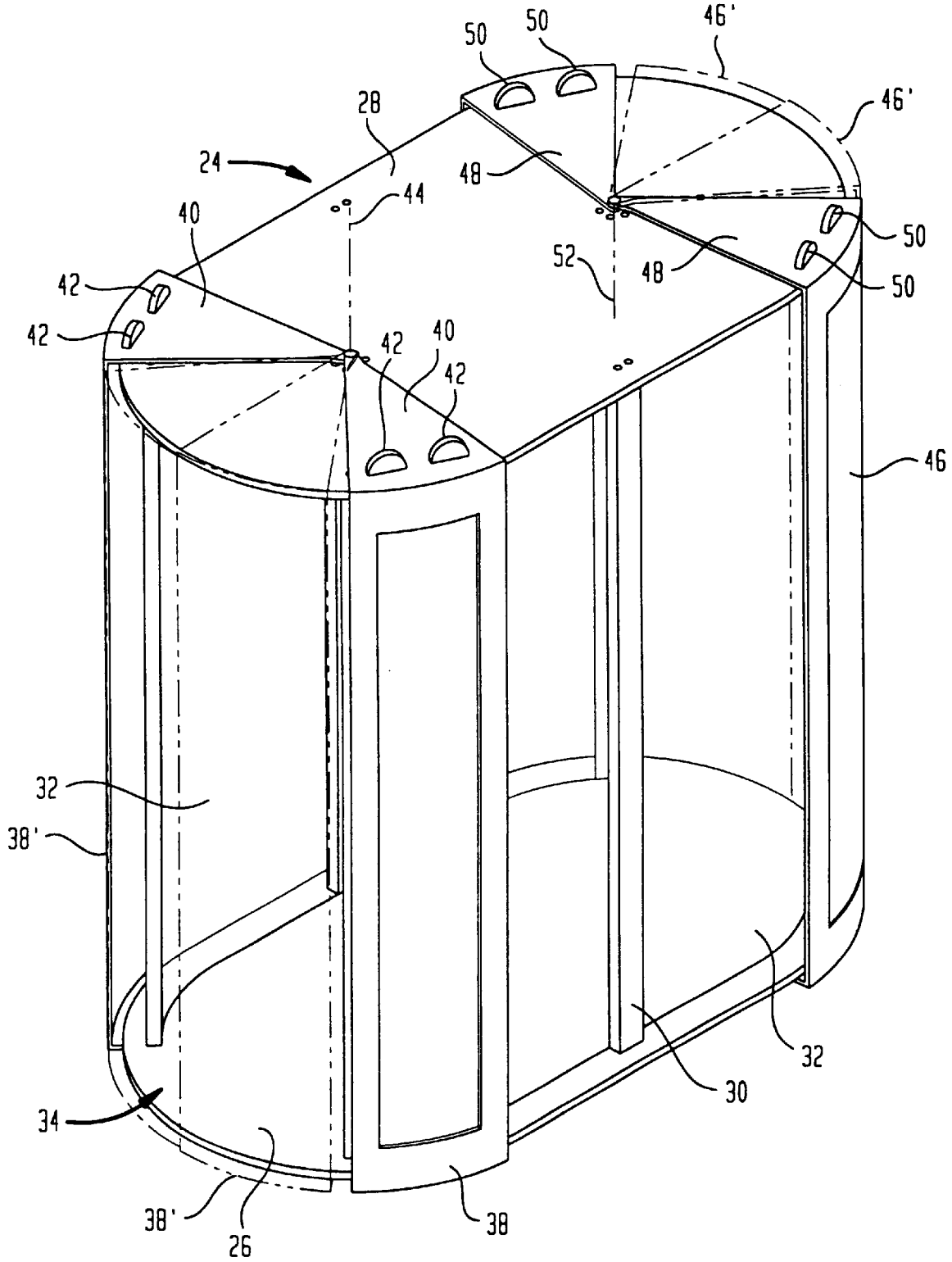
FIG. 3 is a diagrammatic perspective view depicting certain components used in the system of FIG. 1 and 2.
Figure 5:
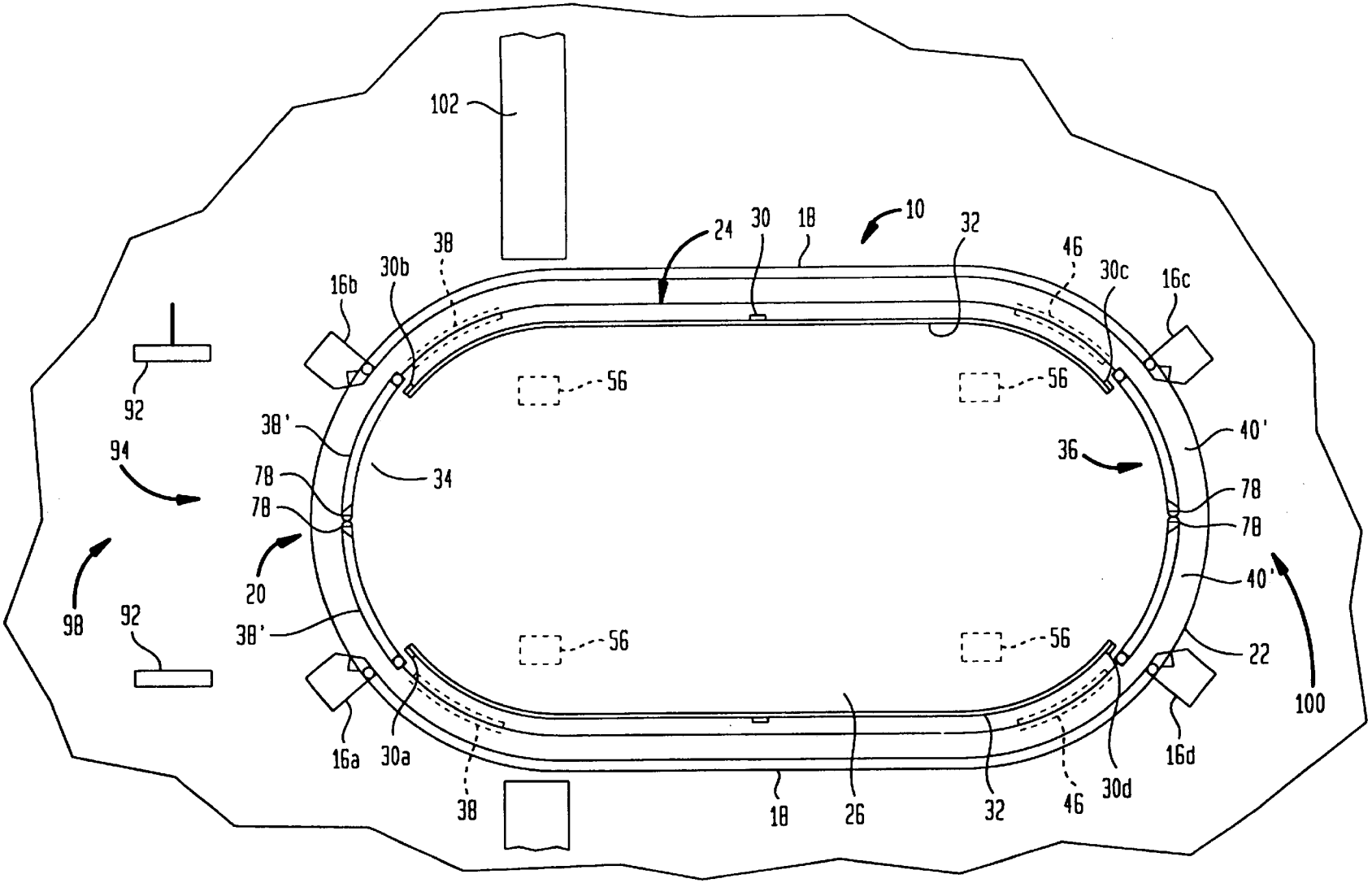
FIG. 5 is a diagrammatic sectional view taken along the line 5—5 in FIG. 1.

The internal structure also includes a pair of first doors 38. Each first door is mounted on a sector element 40 disposed above ceiling element 28 and supported on the ceiling element by a pair of rollers 42. The sector elements 40 and first doors 38 are mounted for pivoting movement about a first door pivot axis 44 so that each door can move from the full open position depicted in solid lines in FIG. 3 to the full closed position 38' depicted in broken lines in FIG. 3. In FIG. 5, the first doors are shown at the full closed position 38' in solid lines and at the full open position 38 in a broken lines. The lower edge of each door 38 is also guided by a track in floor element 26 or other suitable guide elements (not shown). When the first doors 38 are in the full closed position, they block the first or infeed opening 34 of inner structure 24.

The inner structure also includes a pair of second doors 46 which are supported on similar sector elements and rollers 50 and also guided at their lower ends. The second doors are arranged for pivoting movement around a second door axis 52, so that the second doors can move from the full open position 46 and the full closed position 46'. The full closed position is shown in broken lines in FIG. 3 and in solid lines in FIG. 5. When the second doors are in the full closed position, they block the second or protected area opening 36 of the internal structure. When both the first and second doors are in their fully closed positions, the internal structure defines an enclosed chamber bounded by the internal side walls 32 and by the doors 38 and 46.

The internal structure 24 is mounted inside external frame 10, so that the first or infeed end opening 34 is aligned with the first or infeed end opening 34 is aligned with the first or entry end portal 20 of the external frame, whereas the second or protected area end opening 36 of the internal frame is aligned with the second or protected portal 22 of the external frame. As best seen in FIG. 5, the doors 38 and 46 are disposed between the external side wall 18 and the internal side wall 32 when the doors are in their respective open positions. The internal structure 24 is supported within the external frame 10 by a set of load cells 56 physically disposed between the floor element 26 and the lower frame element 12. The load cells are conventional weight-sensing elements arranged to detect the weight of the internal structure 24 and anything disposed inside the chamber defined by the internal structure, and to provide an electrical signal representing the weight. For example, the load cells may be of the strain-gauge type incorporating a resilient member such a spring and a conventional strain gauge arranged to detect the deformation of the spring. Other conventional types of load-sensing elements such as capacitive, magnetostrictive, hydraulic and optical load-sensing elements may be used. Desirably, the load cells are arranged to provide a weighing range from an empty weight equal to the weight of the internal structure alone to a maximum weight equal to the weight of the internal structure plus a maximum load threshold, desirably about 300 Kg or more. The load cells are also arranged to provide sensitivity of about 170 g, at least in the lower end of the weighing range, close to the empty weight.

A motor drive frame 60 (FIG. 4) is mounted within the upper element 14 of the external housing 10. A first motor drive unit 62 and a second motor drive unit 64 are mounted to drive frame 60. The first motor drive unit 62 is connected through a linkage 64 to the sector plates 40 associated with the first doors 38, whereas the second motor drive unit 66 is connected through a similar linkage 68 to the sector plates 50 associated with the second doors 46. Each motor drive unit incorporates a conventional stepper motor and gear train.

The system also includes a controller 70 incorporating a solid state microcontroller such as a Texas Instruments TMS370C756 microcontroller with associated storage elements such as an electronically erasable programmable read-only memory ("EEPROM")(not shown). The controller also includes an appropriate analog circuit for detecting signals from load cells 56 and an internal analog to digital converter. The electrical circuit connected to the load cells desirably also includes field adjustable elements such as potentiometers for nulling the load cells to provide a predetermined signal at the empty weight. The controller also includes the motor drive unit 72 for driving stepper motors 62 and 66 as commanded by the internal logic of the controller and for detecting the positions of the doors of the doors as they move from full open to full closed position.

Switches 74 connected to the controller are provided for detecting when each door is at its full open position or full closed position. The doors are also provided with edge cushions 78 and edge detector 76 is connected to the cushions and to the controller for sensing engagement of foreign objects with the edge cushions. For example, the edge cushions may be conventional pneumatic elements of the type commonly used on self-closing elevator doors and the like, and the edge detector may be a conventional pneumatic device linked to these cushions. Other types of foreign object detectors may be employed instead of such cushions or, preferably, along with the pneumatic cushions. For example, foreign object detectors which direct light beams between the door edges or along the door edges or electrical pressure switches on the door can be used. A keypad 80 and display screen 82 are also linked to the controller 70. Controller 70 is connected to a battery (not shown) and to a mains power supply such as an ordinary power plug for connection to conventional utility power. The controller includes a mains power failure sensor which detects absence of normal power at the utility plug and a low battery sensor which detects the drop in the voltage from the battery.

The system further includes key readers 84 at the infeed end 20 and at the outfeed or protected end 22. The key readers are arranged to read individual keys used by security personnel operating the system. The key readers may be mechanically actuated key switches for conventional devices for reading electrically encoded keys. Desirably, the key readers, together with the controller, are arranged to read keys in any of four classifications, denominated as manager, cleaner, guard or emergency keys. Where electrically or magnetically encoded keys are employed, the controller may be arranged to memorize individual codes on particular keys as belonging to any of the various classes during a key acquisition or learning phase of operation.

The system further includes an actuator 86 and a signal light set 88 at each end. The signal light set is arranged to provide a visible signal indicating to the user when he should proceed into the system as, for example, a green light for proceed and a red light for stop. In the embodiment illustrated, the actuator is simply a push button which can be actuated by any person passing through the system. As further explained below however, more complex actuators, such as biometric or numeric keypad devices may be employed.

The system also includes a contraband detector 90 arranged to detect contraband at the infeed end of the system. The contraband detector may be a conventional electromagnetic or other metal detector having a set of sensing elements 92 disposed adjacent a space 94 just outside of infeed portal 20 and infeed opening 34 (FIG. 5). The metal detector is arranged to provide an alarm signal to controller 70 if metal is detected passing through the detector space 94. One suitable type of metal detector is commercially available under the designation 2PN8HI from the CAA, S.p.A. of Viciomaggio (AZ), Italy.

The system further includes a voice synthesizer (not shown) integrated in controller 70. The voice synthesizer is linked to a speaker 96 disposed within the chamber. An intercom (not shown) may also be provided for allowing communication between a person within the chamber and security personnel outside of the chamber.

Figure 4:
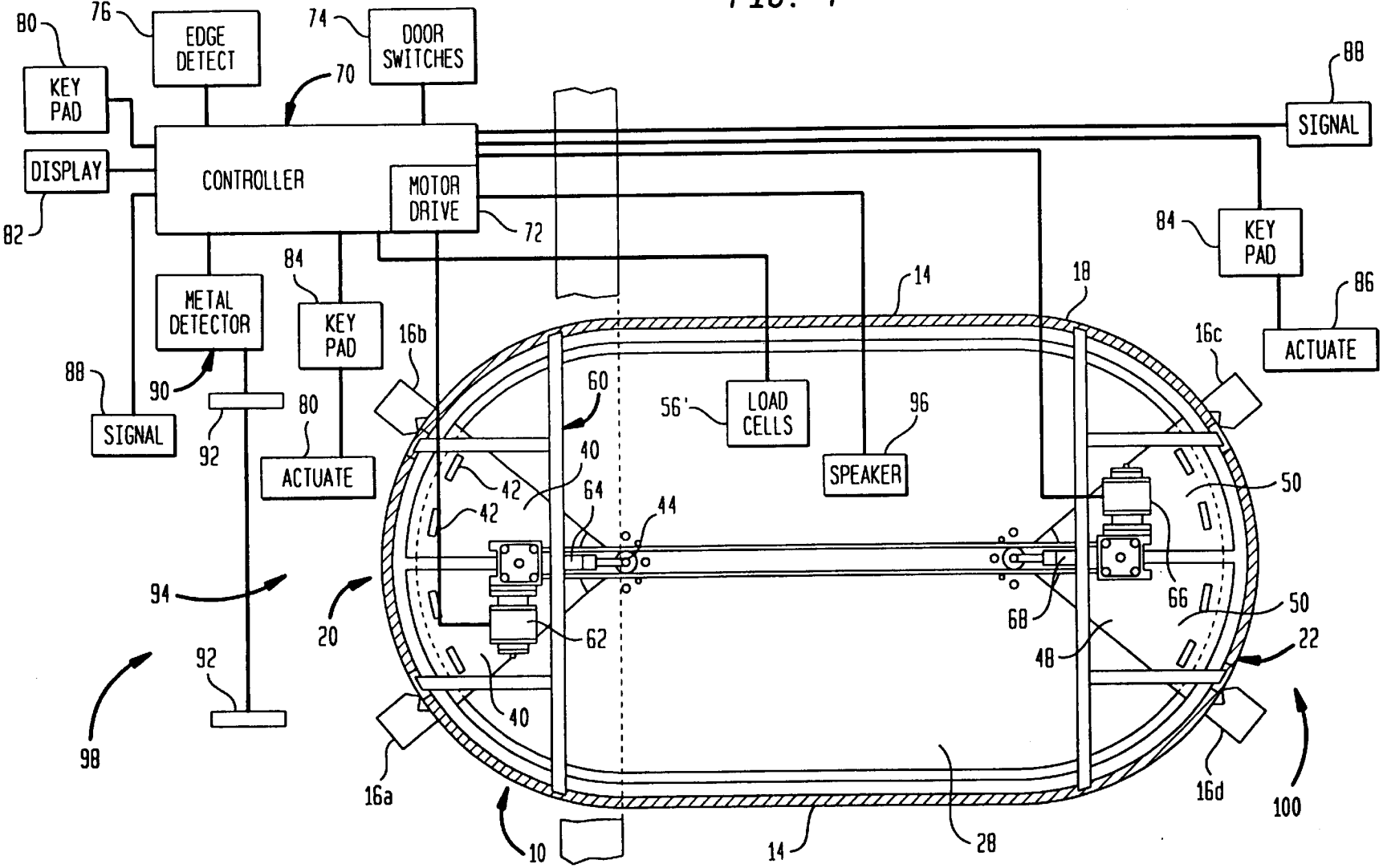
FIG. 4 is a diagrammatic sectional view taken along the lines 4—4 in FIG. 1.

In operation, the system typically is installed at an entry point connecting an infeed or unprotected area 98 and a protected area 100. As shown in FIGS. 4 and 5, the infeed area and the protected area are separated from one another by a wall 102 or other type of barrier, so that a person seeking to enter the protected area from the invfeed area must pass through the system. In one normal operating mode, referred to herein as a bidirectional transit mode, The system weights with first or infeed doors 38 in their full open position and with second doors in their full closed position. A cycle of operations starts when a person seeking entry to the protected area passes through the metal detection space 94 and into the chamber through the entry opening 34. The person's weight is carried by the floor element of the internal structure and transmitted to load cells 56. When load cells 56 determine that the weight of the internal structure and the contents of the chamber is above a preset person-in-chamber threshold (typically set at 170 g or more above the empty weight of the internal structure alone), the controller recognizes that a person has entered the chamber and checks to see if an alarm signal was sent by the metal detector. Provided that no alarm signal was sent by the metal detector, and provided that the weight of the internal structure and chamber contents together is as detected by load cells is below a preset maximum limit, the controller actuates the first door drive unit 62 to close the first doors 38. When the first doors 38 have reached their full closed position, the controller actuates the second doors 46 to open, thereby allowing the person access to the protected area. After a preset time, typically about 5 seconds, sufficient for a person to exit from the chamber, the controller actuates the second doors 46 to close once again.

The controller then rechecks the weight of the internal structure and chamber once again. If the weight of the internal structure and chamber is above the person-in-chamber threshold, indicating that a person still remains within the chamber, the controller actuates the second doors once again, allowing the person a second opportunity to exit from the chamber. Before opening the second doors, the controller may issue a voice command through the loud speaker instructing the person to proceed through the second doors and into the protected area. If the weight of the internal structure and chamber is below the preset person in chamber threshold, indicating that the person has exited from the chamber, the controller actuates the second door drive motor 66 to close second doors 46. When the second doors have reached their full closed position, the controller actuates the first door drive motor 62 to open the first doors, thus readying the system for a new cycle.

If the weight exceeds this maximum threshold, the controller does not open second doors 46, but instead issues a command through speaker 96 directing the person or persons within the chamber to exit the chamber through the first doors, and holds the first doors open. Typically, the weight of the chamber will exceed the maximum threshold if more than one person is in the chamber in a single cycle.

If an alarm signal was issued by metal detector 90, then the controller does not close the first doors or open the second doors as discussed above. Instead, the controller leaves the first doors open and issues a voice command through speaker 96 directing the person to step out of the chamber. When the weight of the chamber and internal structure drops below the person present threshold, indicating that the person has stepped out of the chamber and back into the infeed area, the controller actuates the first door drive motor to close the first or infeed end doors 38. When the first doors reach their full closed position, as indicated by door switches 74, the system waits for a preselected dwell time, sufficient to allow transient effects caused by movement of the person or movement of the doors to dissipate. At this time, the system checks the weight of the chamber and internal structure if the weight of the chamber and internal structure is above a preset concealed object threshold, the controller stops further automatic operation and leaves both doors closed. The controller also issues a perceptible signal such as a message on the display screen indicating an object in chamber alarm. Typically, the concealed object threshold is set to about 170 grams above the empty weight of the chamber and internal structure.

When the controller is in this alarm condition, it can only be reset to resume further automatic operation by manual input from the keypad. Typically, this condition will occur if a person who triggered the metal detector seeks to defeat the system by leaving a gun or other contraband inside the chamber for someone to carry into the protected area in a subsequent cycle.

If the weight of the chamber is below the object in chamber threshold, the controller will clear the alarm signal set by the metal detector and reopen the first doors, whereupon it is ready for another cycle of operations.

If a person wishes to pass in the reverse direction, from the protected area 100 to the infeed area 98, he or she can enter a signal through actuator switch 86 at the protected area end. In response to this signal, the controller closes first doors 38 and then opens second doors 46. When the weight of the chamber and internal structure exceeds the person in chamber threshold, the controller closes the second doors 46 and opens the first doors 38. After the person leaves the chamber, and the weight of the chamber falls below the person in chamber threshold, the controller actuates the first doors to close and again checks the weight of the chamber and internal structure.

If the weight of the chamber is above the weight of the object in chamber threshold, the controller again issues the object in chamber alarm and ceases automatic operation until manually reset by security personnel using the keyboard.

In a variant of the operating procedures discussed above, the system normally waits with the first doors and the second doors closed. The first doors open only when commanded to do so by an input through actuator 86 at the infeed end of the system. In a further variant, the system is set to allow transit through the chamber only from infeed area 98 to protected area 100. Thus, the system disregards input from the actuator 86 at the protected area end of the system. In a further variant, the system closes both doors and executes a residual weight check after each person has exited from the chamber, regardless of whether the metal detector did or did not issue an alarm condition.

The controller senses abnormal conditions. For example, if a set of doors is blocked by an object in their path during closing motion, the door edge detector 76 will issue a signal to the controller, and the controller will reverse the closing motion. The controller is arranged to try the closing motion once again and, if unsuccessful, to reopen the door which it was attempting to close and leave that set of doors in the full open condition. Also, if the door switches 74 do not indicate that a set of doors has reached the full closed or full open position within a preset time after movement was commanded, the controller recognizes that the doors are jammed and stops the automatic movement of the doors. In the event of a mains power failure, the controller disables unnecessary elements such as the signal lights and any internal lighting within the chamber, but continues normal operation. If the controller detects low battery voltage, it disables automatic operation.

The controller also provides for abnormal modes of operation. In an emergency mode, invoked by depressing an emergency key on keypad 80, the controller commands both sets of doors to open. Also, commands entered from the keypad can override the object in chamber, excessive weight or metal detector alarms and allow the second doors to open during normal, automatic operation. Special modes of operation are also provided for cleaning, startup and shut down. These are controlled by appropriate combinations of keys inserted in key readers and signals entered through the keypads associated with the controller.

In the embodiment discussed above, only a single system with a single chamber is connected to the controller. Preferably, however, the controller is arranged so that up to four chambers and their associated doors, metal detectors and weight sensors are controlled by one controller. The controllers in turn may be connected to a master computer in a network arrangement. The controllers desirably are arranged to log all unusual events such as metal detection alarms, object in chamber alarms and the like. The log desirably includes the particular condition and the time at which such condition occurred.

The simple push button actuators 86 provided at the ends of the system may be replaced by more complex actuators such as numeric keypads which require entry of particular codes known only to authorized users or biometric testing devices which measure the body of the user and issue an authorization signal only if the user's physical characteristics match the physical characteristics of an authorized user. The controller is arranged to prevent actuation of one or both sets of doors unless it receives an appropriate actuation signal from such an actuator. This restricts entry to the protected area to only authorized personnel.

In a further variant, the system may be provided with contraband detectors other than metal detectors as, for example, chemically sensitive detectors for detecting explosives or narcotics. Also, contraband detectors may be provided at both ends of the system.

The particular arrangement of doors and door movement devices discussed above is merely exemplary. Numerous other arrangements can be employed. For example, each set of doors may include only one door, so that only one door is provided at the infeed end and one door at the outfeed or protected-area end. Also, the doors may be conventional hinged doors. Many types of actuators other than the stepper motor drives discussed above can be used to drive doors between open and closed positions. For example, other electric motor drives, solenoid power units, pneumatic or hydraulic systems may be employed. In a further variant, the door movement may be performed manually. The controller may be arranged to wait for a door set to be opened or closed, as signaled by door switches, and may be arranged to impede manual opening or closing of one door set until another door set is closed and all other conditions for opening the doors are satisfied. For example, in the normal operating mode discussed above, the controller would be arranged to wait until person had enetered the chamber and had closed the doors at the infeed end before allowing opening of the door at the outfeed or protected area end. The controller would also latch the outfeed or protected area door closed if the metal detector had issued an alarm signal.

The system may be provided with additional features such as a wider door to accommodate persons in wheelchairs. For example, in the United States such access is required in some installations for compliance with the Americans with Disabilities Act "ADA"). Also, the size and shape of the chamber can be varied as desired. For example, instead of the oblong shape illustrated in FIGS. 4 and 5, the chamber may be generally circular in shape.

Figure 6:
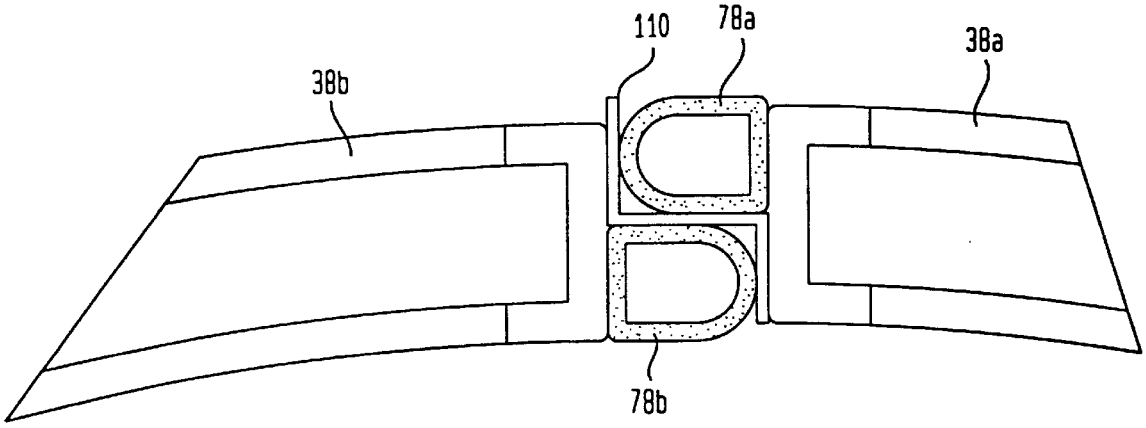
FIG. 6 is a fragmentary sectional view depicting portions of certain elements used in the system of FIGS. 1–5.

As discussed above, pneumatic cushions may be provided on the edges of the doors. These cushions , along with light beam detectors, provide a safety feature in that they detect the presence of a person or other object in the doors and prevent crushing injuries caused by the closing doors. Cushions 78 can be constructed to prevent a person from inserting a blade or other weapon into the chamber through the cushions. To deter such an attack, one of the doors may be provided with a guard flange 110 (FIG. 6) which projects from the door and which overlaps with the protective cushion on the opposing door when the doors are in a full closed condition. Bracket 110 is attached to door 38*a*, whereas door 38*b* has no such bracket. Such a bracket will impair the function of cushion 78 on door 38*a*. However, cushion 78*b* on the opposing door 38*b* will remain fully functional and can detect any foreign object pinched between the doors. In a further variant, cushion 78*a* and bracket 110 are augmented by a solid lip protruding from door 38*a*.

The present invention can be used in the security industry, for protection of buildings and other facilities and areas.

As these and other variations and combination of the features discussed above can be utilized without departing from the present invention, the foregoing description of the preferred embodiments should be taken by way of illustration rather than by way of limitation of the invention as defined by the claims.

What is claimed is:

1. A security entrance system for restricting access from an infeed area to a protected area comprising:

a) a structure defining an enclosed chamber with a first opening connecting the interior of said chamber with said infeed area and a second opening connecting the interior of the chamber with said protected area, said structure including one or more first doors movable between a closed position in which said first doors block said first opening and an open position in which said first doors do not block said first opening, and one or more second doors movable between a closed position in which said second doors block said second opening and an open position in which said second doors do not block said second opening;

b) a contraband detection system operative to detect contraband entering said chamber;

c) a chamber monitoring system connected to said structure for measuring at least one characteristic of said structure defining said chamber; and d) a controller connected to said doors, said detection system and said chamber monitoring system, said controller operating cyclically, each cycle including allowing said first door to open to allow a person entry to said chamber, actuating said detection system to scan said chamber for contraband entering the chamber and allowing said second door to open if no contraband is detected and said first door is closed, thereby allowing the person entry to the protected area, said controller inhibiting operation of at least one of said doors if said at least one characteristic of said structure as determined by said chamber monitoring system while no person is present in said chamber differs from a normal value of such characteristic, whereby said controller will inhibit passage of a person into said protected area if any object is left in said chamber during a preceding cycle.

2. The security entrance system as claimed in claim 1 wherein said at least one characteristic of said structure includes the weight of the structure.

3. The security entrance system as claimed in claim 2 wherein said controller is operative to prevent opening of said first door in one cycle if the weight of said structure detected after completion of a previous cycle differs from the normal weight of said structure.

4. The security entrance system as claimed in claim 3 wherein said controller is operative to permit opening of said first door during any portion of the cycle of operation, and wherein said controller is operative to inhibit opening of said second door while said first door is open, whereby if a person is denied access to said protected area by inhibition of second door opening, such person can pass back into said infeed area from said chamber through said first opening.

5. The security entrance system as claimed in claim 3 wherein said controller includes means for emitting an alarm signal if contraband is detected by said detection system or if the weight of said structure after one cycle differs from said normal weight.

6. The security entrance system as claimed in claim 3 further comprising an outer frame, wherein said chamber monitoring system comprises one or more force transducers operatively connected between said internal structure and said outer frame for detecting the weight of said chamber.

7. The security entrance system as claimed in claim 2 wherein said chamber further includes a sensor at said first door and a sensor at said second door, said sensors detect obstructions at the doors to prevent the doors from closing on a person or object.

8. The security entrance system as claimed in claim 2 wherein said security entrance system further includes an activation system for testing a person seeking entry and providing an authorization signal to said controller if such test is passed, said controller inhibiting operation of at least one of said doors if such test is not passed.

9. The security entrance system as claimed in claim 8 wherein said activation system includes a keypad for manual entry of a code by a person seeking entry and a code comparator for comparing such code to valid codes.

10. The security entrance system as claimed in claim 8 wherein said activation system includes a badge detector for detecting a badge having a predetermined configuration.

11. The security entrance system as claimed in claim 8 wherein said activation system includes a biometric measurement device for measuring a biometric characteristic of a person seeking entry.

12. The security entrance system as claimed in claim 2 wherein said contraband detection system includes a metal detection system.

13. The security entrance system as claimed in claim 1 wherein said structure encloses the interior of said chamber so that a person within said chamber cannot reach any part of the system which is not monitored by said chamber monitoring system when said doors are closed.

14. The security entrance system as claimed in claim 13 wherein when said first and second doors are in said closed positions, said structure entirely encloses said chamber apart from ventilation openings.

15. A method of restricting access to an area comprising the steps consisting of:

a) providing a chamber having one or more first doors and one or more second doors;

b) opening said first doors to allow a person entry to the chamber from an infeed area;

c) sensing for contraband as the person enters the chamber;

d) if no contraband was sensed during entry to the chamber, closing the first door and opening said second door to allow the person access to the protected area, but if contraband was sensed maintaining said second door closed and allowing the first doors to open to provide access from the chamber to the infeed area; and e) detecting the presence of objects remaining in said chamber after the person has vacated the chamber, and inhibiting opening of at least one of said doors if an object is detected in said chamber.

* * * * *

UNITED STATES PATENT AND TRADEMARK OFFICE

CERTIFICATE OF CORRECTION

PATENT NO. : 6,472,984 B1
DATED : October 29, 2002
INVENTOR(S) : Alan J. Risi

It is certified that error appears in the above-identified patent and that said Letters Patent is hereby corrected as shown below:

Column 1,
Line 24, “infeed” area” should read -- infeed area --.

Column 2,
Line 48, “a electromagnetic” should read -- an electromagnetic --.

Column 3,
Line 50, “permit open” should read -- permit opening --.

Column 4,
Line 58, “a infeed” should read -- an infeed --.

Figure 1:
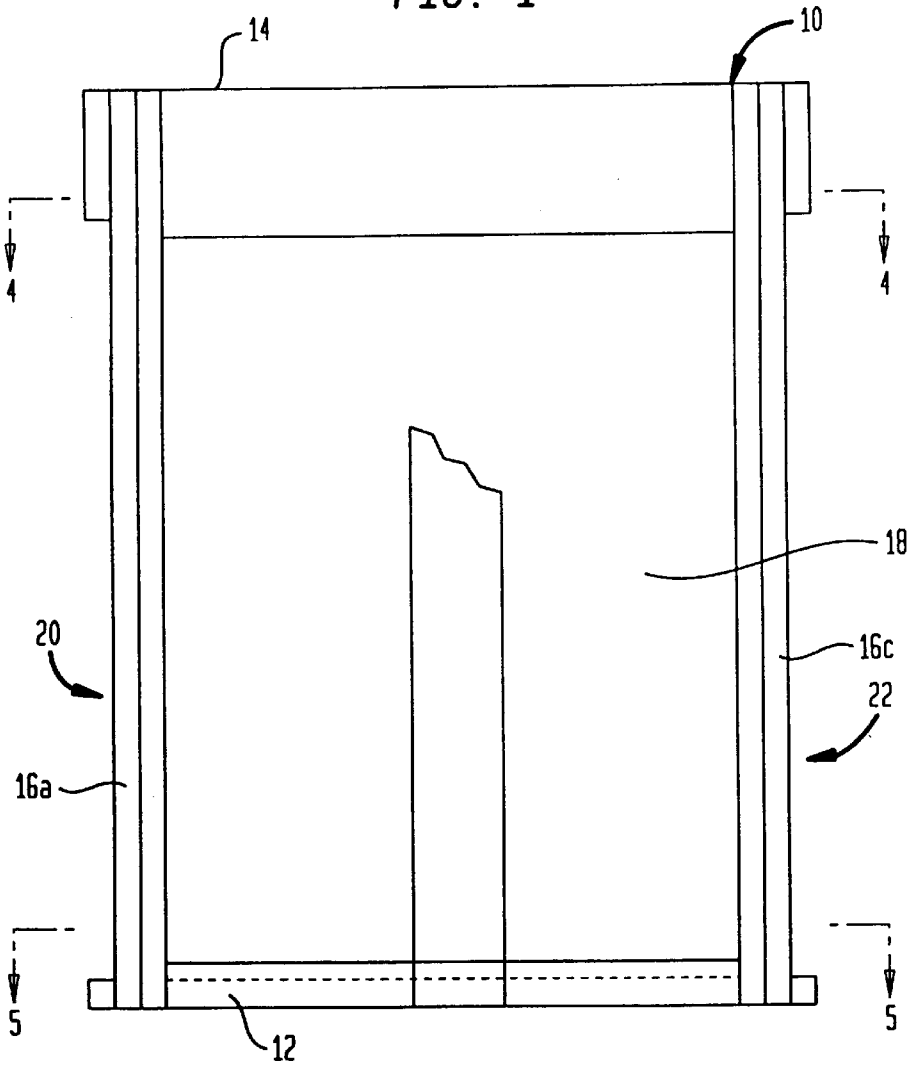
FIG. 1 is a diagrammatic side elevational view depicting a security entrance system in accordance with one embodiment of the invention.

Column 5,
Line 13, “which may be” should read -- may be --.
Line 29, “FIG. 1 and 2” should read -- FIGS. 1 and 2 --.

Column 6,
Line 2, “in a broken” should read -- in broken --.
Lines 22-23, “opening 34 is aligned with the first of infeed end opening 34 is aligned” should read -- opening 34 is aligned --.
Line 39, “such a spring” should read -- such as a spring --.

Column 7,
Lines 7-8, “of the doors of the doors as they” should read -- of the doors as they --.

Column 8,
Line 10, “invfeed” should read -- infeed --.
Line 12, “transit mode, The” should read -- transit mode, the --.
Line 13, “system weights” should read -- system waits --.

UNITED STATES PATENT AND TRADEMARK OFFICE

CERTIFICATE OF CORRECTION

PATENT NO. : 6,472,984 B1
DATED : October 29, 2002
INVENTOR(S) : Alan J. Risi

It is certified that error appears in the above-identified patent and that said Letters Patent is hereby corrected as shown below:

Column 10,
Line 64, "until person had enetered" should read -- until a person entered --.

Column 11,
Line 7, "Act "ADA")" should read -- ACT ("ADA") --.

Signed and Sealed this

First Day of April, 2003

JAMES E. ROGAN
*Director of the United States Patent and Trademark Office*